US008904944B2

(12) United States Patent
Riemens et al.

(10) Patent No.: US 8,904,944 B2
(45) Date of Patent: Dec. 9, 2014

(54) FIRING PRODUCT FEED DEVICE FOR FURNACES WITH CAPACITIES LESS THAN 1 KW

(75) Inventors: André Riemens, Urdorf (CH); Gabriela Vetsch, Urdorf (CH); Basso Salerno, Langenbruck (CH)

(73) Assignee: Stuv S.A., Bois de Villers (BE)

( * ) Notice: Subject to any disclaimer, the term of this patent is extended or adjusted under 35 U.S.C. 154(b) by 964 days.

(21) Appl. No.: 12/997,841

(22) PCT Filed: Jun. 4, 2009

(86) PCT No.: PCT/CH2009/000185

§ 371 (c)(1),
(2), (4) Date: Feb. 10, 2011

(87) PCT Pub. No.: WO2009/149570

PCT Pub. Date: Dec. 17, 2009

(65) Prior Publication Data

US 2011/0120354 A1 May 26, 2011

(30) Foreign Application Priority Data

Jun. 11, 2008 (CH) ..... 882/08

(51) Int. Cl.

| | |
|---|---|
| ***F23K 3/14*** | (2006.01) |
| ***F23H 9/00*** | (2006.01) |
| ***F23B 40/04*** | (2006.01) |
| *F23H 9/02* | (2006.01) |

(52) U.S. Cl.

CPC . *F23K 3/14* (2013.01); *F23B 40/04* (2013.01); *F23H 9/02* (2013.01); *F23H 2700/005* (2013.01); *F23K 2203/202* (2013.01)

USPC ..... 110/247; 110/110; 110/287; 110/327

(58) Field of Classification Search

CPC ..... F23K 3/14; F23K 3/10; F23K 3/12; F23K 2203/202

USPC ..... 110/286, 287, 288, 247, 248, 327, 110; 414/190, 197, 302; 198/670, 673

See application file for complete search history.

(56) References Cited

U.S. PATENT DOCUMENTS

| | | | | |
|---|---|---|---|---|
| 1,876,935 A * | 9/1932 | Hitchcock | ..... | 110/287 |
| 2,320,410 A * | 6/1943 | Cheasley | ..... | 122/374 |

(Continued)

FOREIGN PATENT DOCUMENTS

| | | |
|---|---|---|
| GB | 666686 A | 2/1952 |
| JP | 60-117003 A | 6/1985 |

*Primary Examiner* — Kenneth Rinehart
*Assistant Examiner* — David J Laux
(74) *Attorney, Agent, or Firm* — Edwin D. Schindler

(57) ABSTRACT

A feed device for a granular firing product for furnaces with a minimum capacity of 1 kW, includes a conveyor screw disposed in a pipe for conveying a granular firing product. A central screw axis pipe has an outer wall with a volution mounted thereon and with the conveyor screw disposed in the pipe so that it can rotate and which is at least a quarter of the pipe diameter. The screw pipe axis has a conical shape at its tip, where a circular grating with a central circular hole and air feed openings on the outer region of the grating are horizontally disposed. The central circular hole is smaller than the diameter of the conveyor screw and a conically expanding funnel-shaped wall is guided downwardly from its edge as a sliding wall for a firing product to be conveyed. The conically expanding funnel-shaped wall runs substantially parallel to the cone of the upper end of the screw axis. The inside of the conveyor pipe is provided with a rough surface, preferably longitudinal ribs, so that the firing product is supported and does not rotate with the conveyor screw.

11 Claims, 3 Drawing Sheets

(56) References Cited

U.S. PATENT DOCUMENTS 2,359,638 A * 10/1944 Greger ..... 110/288
2,770,837 A * 11/1956 Reifenhauser ..... 198/548
2,932,712 A * 4/1960 Levin ..... 110/222
2,932,713 A * 4/1960 Powers ..... 110/222
4,548,194 A * 10/1985 Schafer et al. ..... 126/110 R
4,553,285 A * 11/1985 Sachs et al. ..... 110/223
6,126,907 A * 10/2000 Wada ..... 422/184.1

* cited by examiner

FIRING PRODUCT FEED DEVICE FOR FURNACES WITH CAPACITIES LESS THAN 1 KW

BACKGROUND OF THE INVENTION

1. Technical Field of the Invention

The burning of small portions and hence granular firing products, such as wood pellets, wood chippings, small pieces of wood or dried maize proves to be economical and practical to handle. Large and bulky pieces of wood need not be transported and stored, and large logs of wood need not be fed to the fire. However, reducing the furnace capacity to a low value presents problems. If a suitable furnace is operated with a power of less than 1 kW using granular firing products, such as a wood pellet furnace, there is presently no suitable firing product feed device to reliably maintain such a weak fire continuously. In case of such low powers, the first difficulty is to keep the fire burning reliably. The second difficulty is to remove the ashes constantly and the third difficulty is to prevent the fire from reaching the feed flow of the firing product.

2. Description of the Prior Art

Conveyor screws already exist for wood pellet furnaces, which feed the fire with wood pellets continuously or only when needed. Additionally, these conveyor screws are also designed for much higher furnace capacities and it is possible to reduce the capacity to less than 1 kW using them by simply reducing the size of the conveyor screws or by reducing the rotational speed of the conveyor screws. Conventional conveyor screws are usually mounted at an oblique angle and function like an Archimedes screw. Moreover, the available pellet conveyor screws are not suitable for compact wood furnaces with small dimensions. Another problem that is observed is that when the pellets are fed slowly from the bottom into the fire, there is a danger of the fire slowly spreading down into the conveyor screw.

SUMMARY OF THE INVENTION

Based on this state of affairs, the objective of this invention is to develop an improved feed device for granular firing products (charge) for furnaces with capacities less than 1 kW. This furnace should ensure continuous feed and continuous burning of the granular firing product that is fed and also ensure continuous removal of ash, so that the furnace can be operated for long durations without supervision, which is limited only by the size of the firing product reservoir and the ash collector, if these reservoirs are not filled and emptied automatically.

This objective is achieved by a feed device for granular firing products for furnaces with capacities less than 1 kW, which has a conveyor screw disposed in a pipe for conveying the granular firing product and which is characterised in that the central screw axis pipe of the conveyor on whose outer wall the volution is mounted and is disposed in the pipe such that it can rotate with the conveyor screw, fills at least a quarter of the pipe diameter. In addition, this screw axis pipe is cone-shaped at the tip, where a circular grating having a central round hole and air feed openings on the outer region of the grating, is mounted horizontally, whose hole is smaller than the diameter of the conveyor screw and where a conically expanding wall runs downwards from the edge as a sliding wall for the firing product to be fed and is approximately or exactly parallel to the cone of the upper end of the screw axis.

BRIEF DESCRIPTION OF THE DRAWING FIGURES

The feed device for granular firing product will be presented with the help of the drawings and described below and their function will be explained.

DETAILED DESCRIPTION OF THE DRAWING FIGURES AND PREFERRED EMBODIMENTS

The slow upward conveying of granular firing product, which is generally made of cylindrical wood pellets of about 6 mm thick and up to 50 mm long, but are broken into smaller particle while conveying, turns out to be more difficult than one would expect. In case of a conventional conveyor screw, which ends in a grating at the top, the following problems are observed: First, there is great risk that the pellets get wedged together in the conveyor screw and become clumped together, so to speak. A monolithic looking mass is subsequently formed to a certain extent, which acts like a plug because of the jamming and blocks the conveyor screw, even if it is being driven with high torque. In a conveyor screw, it is important that the volution rotates as well as possible under the conveyed charge and the charge must be conveyed to the top in the conveyor pipe without being significantly rotated. This can be achieved very well using so-called pellets or similar granular firing products over short conveying distances. But if the conveyor screw is, for example, 400 mm and longer for an appropriate conveyor height, wedging and clumping is observed due to the weight of the firing product. This depends on various factors such as the rotational speed and dimension of the conveyor screw, the size and wood type of the granular firing product and not just on the humidity. If one wants to design a furnace with a low heating capacity, then a very low Conveyor rate of the firing product must be achieved. If, for example, wood pellets of 6 mm diameter and 10 to 25 mm length are to be vertically fed as slowly as possible over a height of more than 400 mm, the above mentioned problems occur very frequently. It is therefore important to design a feed device for granular firing product using which these problems can be reliably avoided.

Figure 1:
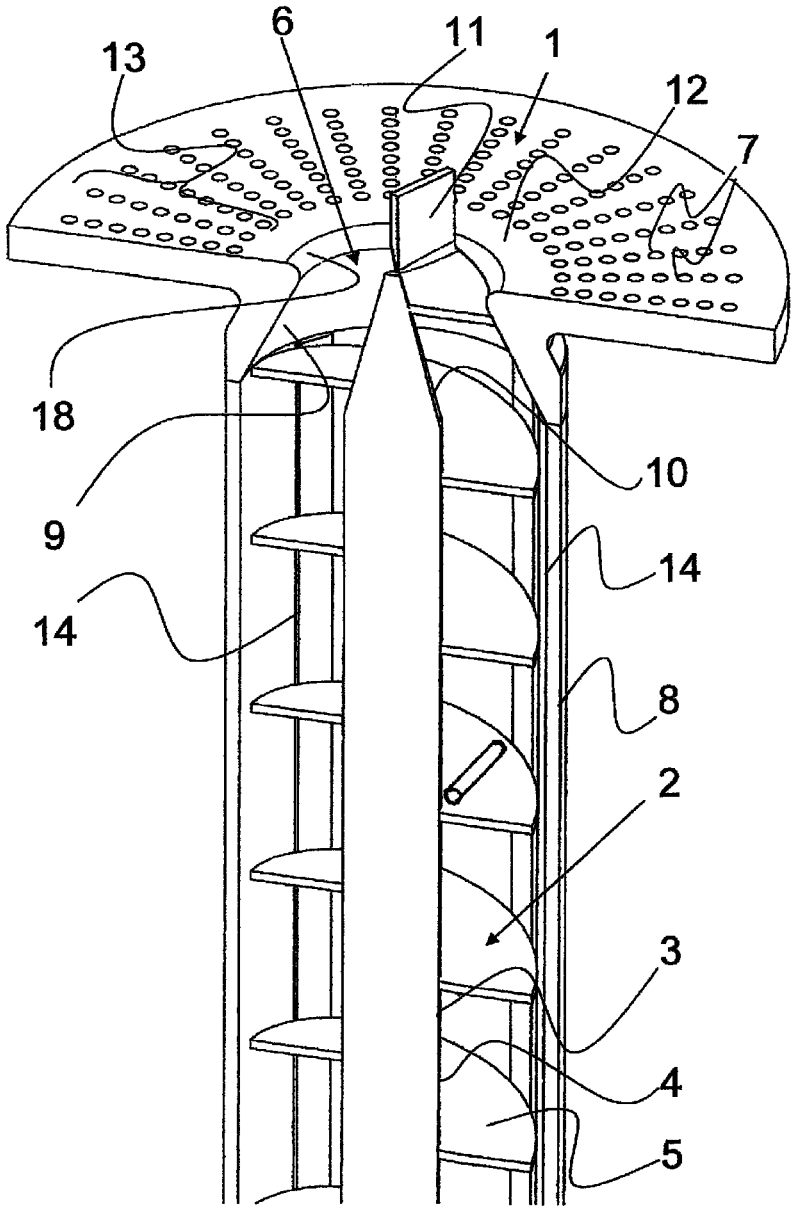
FIG. 1 shows: The feed device with the grating disposed at the upper end in longitudinal section.

FIG. 1 shows such a feed device for granular firing product for furnaces that are designed for capacities less than 1 kW. The firing product can consist of wood pellets as well as wood chippings, small pieces of wood or dried maize and other grains. The grating 1 of the furnace works together with the feed device and is fitted with a conveyor screw 2. The conveyor screw 2 shown in the example, is disposed perpendicular to the grating surface and the central screw axis pipe 3 on whose outer wall 4 the volution 5 is mounted and with which the conveyor screw 2 is mounted in the conveyor pipe 8 such that it can rotate, fills a considerable part of the conveyor pipe 8, which encloses the entire conveyor screw 2. The conveyor pipe 8 with the conveyor screw 2 can also be disposed at an oblique angle to the perpendicular. This ensures additional friction of the firing product on the underside with the conveyor pipe 8, which helps the conveying operation. In the example shown, the pipe diameter of the screw axis pipe 3 is one third the diameter of the conveyor screw or of the conveyor pipe diameter, and this, for example, measures 60 mm. The diameter of the screw axis pipe 3 should be at least a quarter of the conveyor screw diameter, so that a sufficient torque can be transferred to the actual screw 2 and to the helically shaped smooth conveying surface 5 which is looped around the screw axis pipe 3. A single wood pellet 18 is drawn on the conveying surface 5 of the screw 2 to give an approximate dimensional comparison. This screw axis pipe 3 is shaped as a cone 10 at the tip, where the grating 1 with a central circular hole 6 is disposed above the screw 2. It fits precisely to the top end of the conveyor screw axis pipe 8 and is fixed to it.

The grating 1 preferably has a circular design as shown and has air feed openings 7 on the outside surface. The circular hole 6 in the grating 1 measures about half the conveyor pipe diameter. A funnel shaped edge 9 projects downwards from this circular hole 6, which opens as a hopper at the bottom. The hopper wall is almost or exactly parallel to the cone 10 on the screw axis pipe 3. In the example shown, the cone 10 forms an acute angle with the flow direction of the hopper inner wall, with the angular tip facing up. This angle should be kept very small; otherwise it can lead to jamming of the firing product in the area between the cone 10 and the inner wall of the hopper. The actual screw 2 and its looped conveying surface 5 ends in an extension 11 with runs roughly perpendicular to the surface of the grating. The outer side of the extension ends flush on the inner edge of the hole 6 with respect to the rotational axis. The conveyor screw 2 shown here rotates clockwise during operation as seen from above. It could also be designed to convey in the counter-clockwise direction. The firing product that is to be conveyed remains almost in the same position in the conveyor pipe 8 with regards to its rotational position and the conveying surface 5 of the screw 2 slides under the firing product, where it is pushed upwards in the conveyor pipe 8 until it finally reaches the top of the hole 6. For conveying the firing product reliably through the conveyor screw, it is important that the inside of the pipe 8 should be fitted with several, preferably axial, plateaus or ridges 14, past which the volution turns with the minimal distance and leaves a clearance between the top of the plateaus or ridges and the inner wall of the pipe 8. For this purpose, the inner wall of the pipe 8 may also be provided with a rough surface.

The conveyor screw 2 rotates very slowly, with a rotational speed of less than 1 rotation per minute. The firing product which reaches the top is collected by the extension 11 and shifted around in the clockwise direction as seen from above. At the point where the extension makes contact with the edge of the hole 6, its absolute speed is only about 1.5-2.0 mm/s. This slow rotation of the extension 11 however ensures that the firing products are pushed outwards due to the radially acting forces and eventually reach the area 12 of the grating 1. This area, a concentric ring that connects to the hole 6 in the grating 1, does not have any air feed openings 7. Accordingly, the firing product does not burn well there and need to be pushed radially outward. This takes place in the next run of the extension 11 when the firing products are slightly pushed onto the grating. In this way, the firing products are pushed very slowly onto the grating every minute, by each operation of the extension 11 and subsequently moved to the firing zone represented by area 13, which is equipped with air feed openings 7. The diameter of the entire grating 1 is about twice the diameter of the conveyor pipe 8. If this is 60 mm, the grating 1 is about 120 mm in diameter. Through step-by-step and continuous feed of fresh firing product a nice, high and regular flame aspect is achieved on the grating 1 which does not flicker.

Figure 2:
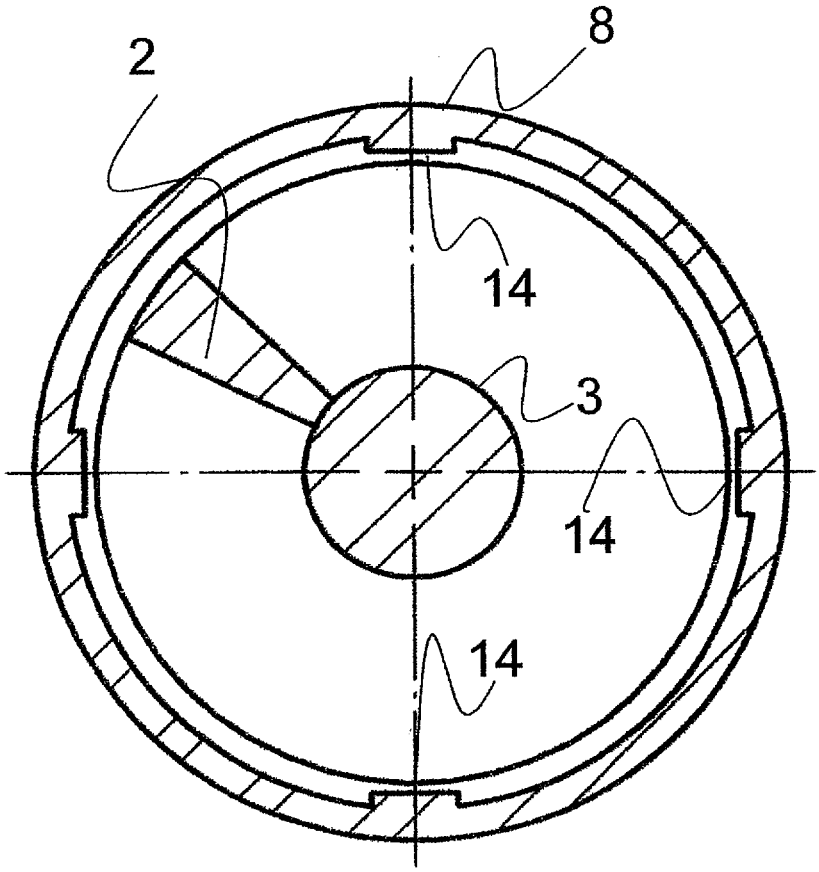
FIG. 2 shows: A cross section through the conveyor screw seen from above.

FIG. 2 shows the cross section of a conveyor screw and the conveyor pipe 8. One can see the ridges and the elevations 14 on the inner side of the conveyor pipe 8 as well as a segment of the actual screw 2, whose outer edge passes close to these elevations 14. 1. The firing product particles are supported by these ridges or elevations that help in preventing them from rotating with the conveyor screw 2. The rotation of the conveyor screw 2, which slides under the firing product generates a force component which works radially outward. Accordingly, the firing product is pressed against the inner wall of the conveyor pipe 8 and is supported by the elevations. If the outermost particles of the firing product are supported there, they in turn support the adjacent particles on the inside and so on, so that the rotation of the firing product is effectively avoided, regardless of whether the firing product consists of wood pellets, wood chippings, small pieces of wood or dried maize kernels or something similar.

Figure 3:
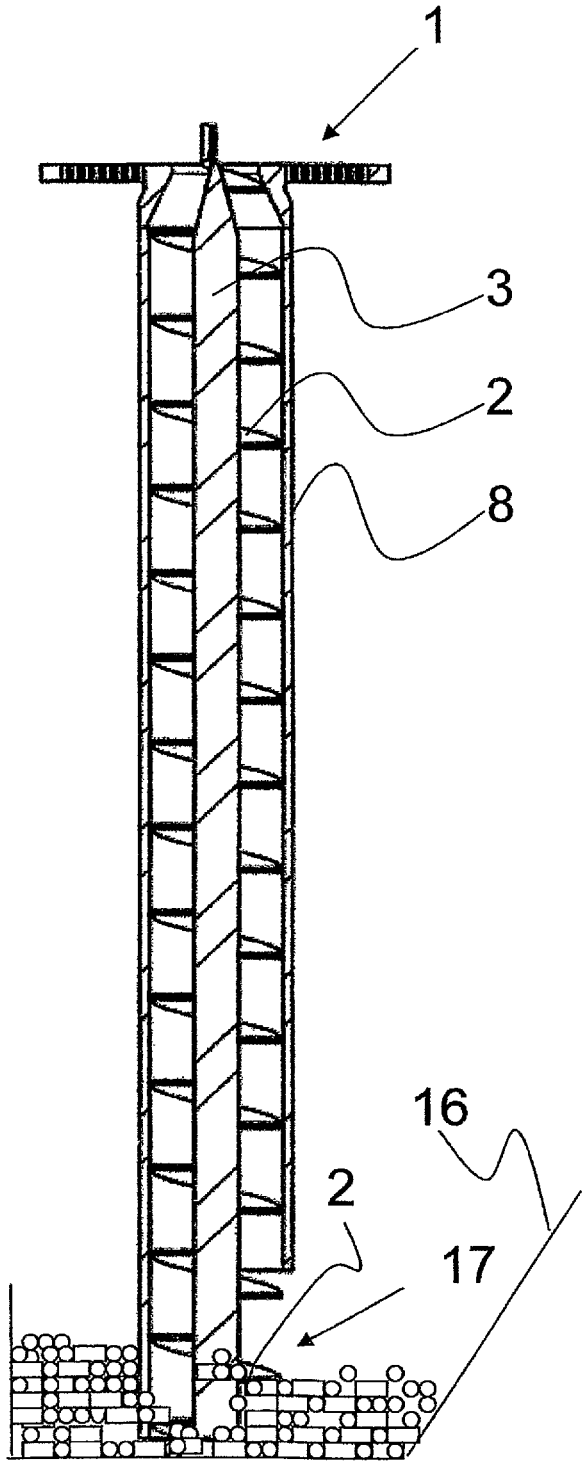
FIG. 3 shows: The entire conveyor screw seen from the side, shown in longitudinal section.

FIG. 3 shows the complete conveyor screw 2. It has a height of 200 mm to 800 mm and a diameter of 55 mm to 85 mm. The axis pipe (3) of the conveyor screw has a diameter of a quarter to slightly more than a third of the diameter and the pitch of the volution per rotation is about half the conveyor screw diameter. At the bottom, the conveyor pipe 8 can stand in a pile or box 15 of firing product particles that can be loaded with the firing product from above or over an inclined surface 16 as feed hopper. The conveyor pipe 8 is open on one side at the bottom and the firing product pieces, cylindrical wood pellets in the example, trickles through this opening 17 in the conveyor pipe 8 to the screw 2.

The firing product feed device for such wood furnaces for capacities less than 1 kW is equipped with an electric motor that drives the screw 2 using a step-down gear. Depending on the voltage-dependent control of the electric motor, the rotational speed of the conveyor screw 2 can be adjusted between 0.5 to 2 revolutions per minute and thus the feed quantity of firing product can be controlled per unit time and thus the heating capacity.

The invention claimed is:

1. A feed device for a granular firing product for a furnace with a capacity of less than 1 kW, comprising:

a conveyor pipe;

a conveyor screw disposed in said conveyor pipe;

a central screw axis pipe having an outer wall with a volution mounted thereon and with said conveyor screw disposed in said conveyor pipe so that it is rotabable, said volution measuring at least a quarter of a diameter of said conveyor pipe, said central screw axis pipe being shaped as a cone at a tip of said central screw axis pipe, wherein a circular grating having a central circular hole and air feed openings on an outer region of said circular grating is horizontally disposed, the central circular hole being smaller in diameter than a diameter of said conveyor screw and wherein volution of said conveyor screw is conveyed in said circular grating until a level of the central circular hole and then ends in a vertical extension, which then projects over said circular grating; and, a conically expanding funnel-shaped wall is guided downwardly as a sliding wall for a firing product to be conveyed, said conically expanding funnel-shaped wall running substantially parallel to said cone of an upper end of said central screw axis pipe.

2. The feed device for a granular firing product for a furnace with a capacity of less than 1 kW according to claim 1, wherein the central circular hole is half a diameter of said conveyor pipe for said conveyor screw and said circular grating has a diameter of at least twice said conveyor on an outer side.

3. The feed device for a granular firing product for a furnace with a capacity of less than 1 kW according to claim 1, wherein said conveyor screw and said volution are made of steel, and an inner surface of said conveyor pipe has a plurality of axially running plateaus or ridges, passed which said volution rotates with minimal distance and leaves a clearance between a top of said plurality of axially running plateaus or ridges and said inner surface of said conveyor pipe.

4. The feed device for a granular firing product for a furnace with a capacity of less than 1 kW according to claim 1, wherein said conveyor pipe has an inner surface having a degree of friction.

5. The feed device for a granular firing product for a furnace with a capacity of less than 1 kW according to claim 1, wherein said conveyor screw has a height of 500 mm to 600 mm and has a diameter of 55 mm to 65 mm, while said central screw axis pipe has a diameter of one-third of the diameter of said conveyor screw and a pitch of said volution per rotation is approximately half the diameter of said conveyor screw.

6. The feed device for a granular firing product for a furnace with a capacity of less than 1 kW according to claim 1, wherein said circular grating fits on a top end of said central screw axis pipe.

7. The feed device for a granular firing product for a furnace with a capacity of less than 1 kW according to claim 1, further comprising a pellet feed device drivable with an electric motor having a step-down gear, so that rotational speed of said conveyor screw is adjustable to 0.5-2 revolutions/minute depending upon a voltage-dependent control of the electric motor.

8. The feed device for a granular firing product for a furnace with a capacity of less than 1 kW according to claim 1, wherein said vertical extension has an outer side that ends flush on an inner edge of the central circular hole.

9. The feed device for a granular firing product for a furnace with a capacity of less than 1 kW according to claim 8, wherein said circular grating fits on a top end of said central screw axis pipe.

10. The feed device for a granular firing product for a furnace with a capacity of less than 1 kW according to claim 1, wherein said circular grating includes an area around the central circular hole having no air feed openings.

11. The feed device for a granular firing product for a furnace with a capacity of less than 1 kW according to claim 10, wherein said area around the central circular hole is a concentric ring connecting to the circular hole in said circular grating.

* * * * *